US007329302B2

(12) United States Patent
McCall

(10) Patent No.: US 7,329,302 B2
(45) Date of Patent: Feb. 12, 2008

(54) LUBRICANTS FOR POWDERED METALS AND POWDERED METAL COMPOSITIONS CONTAINING SAID LUBRICANTS

(75) Inventor: James M. McCall, Montreal (CA)

(73) Assignee: H. L. Blachford Ltd./Ltee, Quebec (CA)

( * ) Notice: Subject to any disclaimer, the term of this patent is extended or adjusted under 35 U.S.C. 154(b) by 0 days.

(21) Appl. No.: 10/982,368

(22) Filed: Nov. 5, 2004

(65) Prior Publication Data

US 2006/0099104 A1 May 11, 2006

(51) Int. Cl.
*B22F 1/00* (2006.01)
*B22F 3/12* (2006.01)
*C01M 111/00* (2006.01)

(52) U.S. Cl. ..... 75/252; 419/37; 419/38; 508/528; 508/551

(58) Field of Classification Search ..... 75/252; 419/37, 38; 508/528, 551
See application file for complete search history.

(56) References Cited

U.S. PATENT DOCUMENTS

| | | | | |
|---|---|---|---|---|
| 4,002,474 | A | 1/1977 | Blachford | |
| 5,368,630 | A * | 11/1994 | Luk | 75/252 |
| 5,476,534 | A * | 12/1995 | Ogura et al. | 75/252 |
| 5,554,338 | A * | 9/1996 | Sugihara et al. | 419/5 |
| 5,624,631 | A | 4/1997 | Luk | |
| 5,976,215 | A | 11/1999 | Uenosono et al. | |
| 6,126,715 | A | 10/2000 | Luk | |
| 6,139,600 | A * | 10/2000 | Ozaki et al. | 75/255 |
| 6,203,753 | B1 * | 3/2001 | Donaldson | 419/54 |
| 6,231,635 | B1 * | 5/2001 | Suzuki et al. | 75/252 |
| 6,395,688 | B2 | 5/2002 | Vidarsson | |
| 6,413,912 | B2 | 7/2002 | Hall | |
| 6,413,919 | B2 | 7/2002 | Vidarsson | |
| 6,648,941 | B2 | 11/2003 | Uenosono et al. | |
| 2003/0215349 | A1 * | 11/2003 | Nakamura et al. | 419/29 |

FOREIGN PATENT DOCUMENTS

| | | |
|---|---|---|
| CA | 2262508 | 2/1998 |
| WO | WO 2004/039520 | 5/2004 |

* cited by examiner

*Primary Examiner*—Roy King
*Assistant Examiner*—Ngoclan T. Mai
(74) *Attorney, Agent, or Firm*—Bachman & LaPointe, P.C.

(57) ABSTRACT

Particulate lubricants are disclosed which comprise discrete particles of a fatty monoamide, especially oleamide and discrete particles of at least one other powder metallurgy lubricant, which provide a synergistic free-flowing composition; there are also provided novel compositions of matter for forming sintered metal components comprising a mixture of sinterable powdered metal and the particulate lubricants.

24 Claims, No Drawings

LUBRICANTS FOR POWDERED METALS AND POWDERED METAL COMPOSITIONS CONTAINING SAID LUBRICANTS

BACKGROUND OF THE INVENTION (a) Field of the Invention

This invention relates to lubricants for powder metallurgy and to the manufacture and use of lubricants.

More particularly the lubricant comprises an admixture of particulate lubricants comprising discrete particles of a fatty monoamide, especially oleamide as one of the components.

(b) Description of Prior Art

Powdered metals, for example, powdered iron, are used to make small, fairly intricate parts, for example, gears. The fabrication of such metallic parts by powdered metal technology involves the following steps:

(a) the powdered metal is blended with a lubricant and other additives to form a mixture, (b) the mixture is poured into a mold, (c) the mixture is compacted in the mold to form a part using high pressure, usually of the order of 30 tons per square inch, (d) after compaction the part is ejected from the mold, (e) the ejected part is subjected to a high temperature to decompose and remove the lubricant, (f) the part is heated to a higher temperature to cause all of the particles of metal in the part to sinter together and (g) the part is cooled, after which it is ready for use.

Commonly used lubricants include lithium stearate, lithium 12-hydroxystearate, ethylenebisstearamide, and stearic acid.

The lubricant is added to the powdered metal for several reasons; in particular the lubricant increases the bulk density of the uncompacted powdered metal. This means that the molds can be shallower, for a given thickness of the final part. The bulk density is generally referred to as the apparent density and is determined according to the Metal Powder Industries Federation Standard No. 04, Determination of Apparent Density of Free-Flowing Metal Powders Using the Hall Apparatus.

Some lubricants increase the rate of addition of the metal powder to the mold, when admixed with the powder. A standard laboratory test for this is the time taken for 50.0 grams of metal powder with admixed lubricant to flow through a standard cup. This property is commonly referred to as the flow rate of the mixture and is determined as described by the Metal Powder Industries Federation Standard No. 03, Determination of Flow Rate of Free-Flowing Metal Powders Using the Hall Apparatus.

The lubricant allows the compacting pressure to be reduced to attain a specified density before sintering. This is very important because it means that for a given pressure a larger part can be made. Because of the very large pressures required to compact powdered metal, only relatively small parts are made. The density of the compacted (pre-sintered) part is called the green density.

The strength of the compacted (pre-sintered) part is called the green strength of the part. It can be determined as described by the Metal Powder Industries Federation Standard No. 15, Determination of Green Strength of Compacted Metal Powder Specimens.

The ejection force to remove the compacted part from the mold is much lower when a lubricant is present and this lower force results in less mold wear.

Unfortunately, the lubricant also has a few adverse effects; some lubricants reduce the flow rate of the powdered metal and therefore the rate at which a mold can be filled; the lubricant may reduce the strength of the compacted (pre-sintered) part, referred to as the green strength; further, the lubricant can cause an unattractive surface finish on the sintered part. Zinc stearate is commonly used as a lubricant and slowly deposits a thin coating of zinc and zinc oxide on the walls of the furnace used to burn off the lubricant or on the walls of the sintering furnace.

This last disadvantage is often serious, and because of it a wax is sometimes used instead of zinc stearate. The most commonly used wax is ethylenebisstearamide; however, it is not as good a lubricant as zinc stearate, especially with regard to compressibility, i.e., it gives a lower green density for a given compacting pressure. It can only provide the same compressibility as zinc stearate if it is ground to a very fine powder using a special grinding mill which is expensive and consumes a great deal of energy.

A further disadvantage of zinc stearate is that some of the zinc oxide that results from its decomposition in the sintering furnace is also vented into the atmosphere. The amount of zinc oxide emissions is monitored by regulatory authorities. Installation of pollution abatement equipment is costly and thus minimizing the production of evolved zinc oxide at the source is a more desirable approach. For these reasons, the powder metallurgy industry is migrating away from zinc stearate-containing lubricants wherever possible. Hence, zinc stearate-containing compositions are not considered in this invention.

U.S. Pat. Nos. 5,368,630 and 5,429,792 describe lubricated metal powder compositions which contain an organic binder. The compositions are designed for high temperature use above 100° C. The organic binder is an essential component to achieve dust-free, segregation-free metal powder compositions. The binding agent is introduced in a solvent which is subsequently removed from the powder metal composition. The U.S. Patents teach that not all conventional powder metallurgy lubricants may be employed where compaction is carried out at the high temperature.

SUMMARY OF THE INVENTION

It is an object of this invention to provide a novel lubricant composition for powdered metals.

It is a further object of this invention to provide a method of forming a sintered metal part, employing a lubricant composition of the invention.

It is yet another object of this invention to provide a novel composition of matter for the manufacture of a sintered metal article.

In accordance with one aspect of the invention there is provided a method of forming a sintered metal part comprising:

compacting a sinterable powdered metal in admixture with a particulate lubricant in a mold to form a compacted powdered metal part, removing the compacted part from the mold, heating the compacted part to decompose and remove the lubricant and sinter the particles of metal with formation of the sintered metal part, said lubricant comprising of a mixture of discrete particles of a fatty monoamide and discrete particles of at least one other powder metallurgy lubricant.

In accordance with another aspect of the invention there is provided a synergistic free-flowing lubricant composition for powder metallurgy comprising discrete particles of a fatty monoamide and discrete particles of at least one other powder metallurgy lubricant, in admixture.

In accordance with still another aspect of the invention there is provided a composition of matter for the manufacture of a sintered metal article comprising a sinterable mixture comprising a metal powder and a particulate lubricant, said lubricant being present in an amount of 0.1% to 5%, by weight, said lubricant comprising a mixture of discrete particles of a fatty monoamide and discrete particles of at least one other powder metallurgy lubricant.

In accordance with the invention the second component i.e. the "other powder metallurgy lubricant" is other than zinc stearate.

DESCRIPTION OF PREFERRED EMBODIMENTS i) Lubricant

The fatty monoamide is, more especially an amide of a fatty acid, saturated or unsaturated, of 8 to 22 carbon atoms. Especially preferred is oleamide. The fatty monoamide is in particulate form, the particle having a particle size below about 300 microns, and particularly in a size range of below about 150 microns.

Fatty acid in this specification is to be understood as embracing both naturally, derived and synthetically derived carboxylic acids of 8 to 22, preferably 12 to 20 carbon atoms and being saturated or unsaturated.

The invention is more particularly described hereinafter by reference to the preferred embodiment in which the particulate fatty monoamide is oleamide.

The particulate lubricant is preferably a synergistic free-flowing mixture containing from 5 to 95%, by weight, of discrete particles of oleamide and from 95 to 5%, by weight, of discrete particles of at least one other powder metallurgy lubricant.

In preferred embodiments, the mixture contains from 10 to 60%, by weight, of the oleamide and from 90 to 40%, by weight of the at least one other lubricant, to a total of 100%.

In especially preferred embodiments the particulate lubricant mixture contains oleamide, ethylenebisstearamide, and one other powder metallurgy lubricant.

The at least one other powder metallurgy lubricant may be, for example, a metal stearate such as lithium stearate; a metal hydroxystearate such as lithium 12-hydroxystearate; or a fatty bisamide such as ethylenebisstearamide, as well as other conventional powder metallurgy lubricants for example a fatty acid such as stearic acid. The indicated lubricants are merely representative of conventional particulate powder metallurgy lubricants which may be employed in admixture with oleamide in accordance with the invention.

Examples of saturated fatty monoamides include caprylamide, pelargonamide, capramide, lauramide, myristamide, palmitamide, stearamide, arachidamide, behenamide, and stearyl stearamide. Examples of unsaturated fatty monoamides include palmitoleamide, oleamide, erucamide, linoleamide, linolenamide, oleyl palmitamide, stearyl erucamide, erucyl erucamide, oleyl oleamide, and erucyl stearamide. An example of a hydroxy unsaturated fatty monoamide is ricinoleamide.

Examples of fatty bisamides include ethylenebisstearamide, ethylenebisoleamide, and ethylenebis12-hydroxystearamide.

The at least one other powder metallurgy lubricant is in particulate form, the particles having a particle size below about 300 microns, and particularly in a size range below about 150 microns.

The admixture of the oleamide and the at least one other conventional or powder metallurgy lubricant forms a synergistic free-flowing particulate composition which provides advantages in powder metallurgy over the conventional powder metallurgy lubricants.

The synergistic free-flowing lubricant mixture does not require organic binders employed in powder metallurgy, which organic binders are sometimes employed to bind the particles of metal powder prior to compaction. As such the particulate lubricant of the invention may be free of such binders.

A dry mixture of metal powder, additives such as graphite and copper, and discrete particles of oleamide and the at least one other powder metallurgy lubricant is prepared by adding the additives, oleamide, and the at least one other powder metallurgy lubricant to the metal powder and then blending them together using conventional blenders and mixers.

The additives, oleamide and the at least one other powder metallurgy lubricant can also be added step-wise in any order desired to the metal powder, and then the combined admixture mixed using conventional blenders and mixers.

When mixed with metal powders, the concentration of the lubricant is suitably in the range of 0.1 to 5% by weight, preferably from 0.1 to 1% by weight, and most preferably from 0.2 to 0.8% by weight, based on the total weight of metal powder, lubricant and any additives.

The method can be employed in the manufacture of sintered metal parts from a variety of powdered sinterable metals including ferrous metals, for example iron and steel, and non-ferrous metals, for example aluminum, copper and zinc, as well as powdered metal alloys, for example brass powder or mixtures of powdered metals, mixtures of powdered metal alloys and mixtures of powdered metals and powdered metal alloys. It will be understood that such sinterable metal powders and powdered metal alloys may also include conventional additives, for example, graphite or copper which are often employed in admixture with iron, as well as other alloying metals and phosphorus.

The particulate lubricant may also be employed in the manufacture of sintered parts from sinterable metal oxides, and sinterable metal salts, for example, uranium oxide and barium ferrite.

The particulate lubricant may additionally be employed in the manufacture of parts from powdered metals which may not require sintering, such as for magnets.

The particulate lubricant will generally consist of solid discrete particles of the lubricant components, preferably below about 300 microns, more preferably below about 150 microns. Particles that are too large can lead to segregation in the admixture of metal powder and lubricant, or to voids in the sintered parts made from the admixture.

The improved property of compacted parts made with the particulate lubricants of the invention lies in the lower force required to eject parts made with the particulate lubricants from the mold. Parts made with the particulate lubricants have much higher green strengths than those made with the conventional lubricants such as lithium stearate.

Preferred lubricants are admixtures of oleamide powder with one or more metal stearates such as, but not limited to, lithium stearate.

U.S. Pat. Nos. 6,395,688 and 6,413,919 discuss lubricant compositions containing a composite of two components where the first component is selected from the group consisting of fatty bisamides and fatty monoamides and the second component is selected from the group consisting of metal soaps. The components are subjected to a heat treatment in order to obtain their useful composite forms. These lubricant compositions do not contain discrete particles of the lubricant components and the particulate integrity of the lubricant components is not maintained. Both U.S. patents are silent with respect to any benefit of the compositions in easing of ejection of parts from a tool. Apparent Density and Flow Rate are reported in these patents for mixtures of metal powder and lubricant powder, and changes in these properties do not necessarily correlate with changes in the green properties of parts compacted from the mixtures of metal powder and lubricant powder.

ii) Production of Sintered Metal Article

The particulate lubricant of the invention is advantageously employed in the manufacture of sintered metal articles from powdered metal.

In this method the powdered metal is mixed or blended with the particulate lubricant to form an intimate mixture.

The mixture is compacted in a mold at below about 100° C., and more generally below 95° C., at a pressure effective to form the mixture into a self-supporting shaped body. The compacting pressure depends on the particular metal powder and may be from 1 t.s.i. to 100 t.s.i.; generally compacting pressures of 10 t.s.i. to 75 t.s.i. are satisfactory.

During compaction of powder and ejection of compacted parts from a die, where neither the powder nor the die are being heated externally, the parts heat up due to friction between metal particles and between the compacted part and the die walls. After several compacted parts have been produced, the die also may be warmer than ambient temperature because of these frictional effects. The temperature of a green compact can range from 80° F. (27° C.) to 200° F. (93° C.) with 145° F. (63° C.) being typical.

The compacted part has the form of a self-supporting body which is removed from the mold and is heated to decompose and remove the lubricant and to sinter the metal particles. This heating operation may take place in two separate stages, most of the lubricant being removed in a first heating stage and any residual material subsequently being removed in the sintering furnace. The lubricant could be removed entirely in the sintering furnace but this results in deposits on the interior of the sintering furnace which may serve to decrease the efficiency of the furnace over a period of time.

Thus in a particular embodiment the compacted part is ejected from the mold and is heated to a first elevated temperature effective to decompose and remove the lubricant, and then to a second elevated temperature effective for sintering of the particles of metal, the second temperature being higher than the first temperature.

The green strengths in the following Examples were determined for compacted bars measuring about 1.25 inches long, about 0.5 inch wide, and about 0.25 inch high. Green strengths were measured for these bars under conditions of 3-point loading with a span of 1 inch. Ejection loads in the following Examples were determined for compacted solid cylinders measuring about 0.75 inch diameter and 0.67 inch high. The bars and cylinders were prepared by compacting the admixtures to a density of about 7.0 g/cm$^3$.

EXAMPLE 1

The properties of mixtures of ASC 100.29 iron powder containing about 0.80% lubricant by weight of ASC 100.29 are given in Table I. Powder properties (Flow Rate (sec/50 g), Apparent Density (g/cm$^3$)) and Green Properties (Ejection load and Strength) are reported. The mixture containing oleamide did not flow and this prevented the measurement of the Apparent Density and Flow Rate. Lubricant A was prepared by intimately mixing 60% by weight ethylenebisstearamide with 20% by weight of oleamide with 20% by weight of lithium stearate. Lubricant A was free-flowing and gave an ejection load which was much lower than that expected on the basis of the ejection loads for compositions comprising just the individual components. The synergistic effect of the lubricant composition for powder metallurgy comprising oleamide and at least one other powder metallurgy lubricant in admixture was unexpected.

TABLE I

| Lubricant | Powder Flow Rate, sec/50 g | Powder App. Dens., g/cm$^3$ |
|---|---|---|
| Ethylenebisstearamide | 34.4 | 3.23 |
| Lithium stearate | 27.7 | 3.34 |
| Oleamide | No flow | No flow |
| Lubricant A | 25.3 | 3.19 |
| **Lubricant** | **Green Ejection, lbs.f** | **Green Strength, MPa** |
| Ethylenebisstearamide | 13937 | 15.45 |
| Lithium stearate | 11367 | 11.54 |
| Oleamide | 9680 | 21.77 |
| Lubricant A | 7863 | 14.32 |

EXAMPLE 2

The properties of mixtures of Kobelco 300MA iron powder containing about 2.0% copper by weight of Kobelco 300MA powder, about 0.8% graphite by weight of Kobelco 300MA powder, and about 0.80% lubricant by weight of Kobelco 300MA powder are given in Table II. Powder properties (Flow Rate (sec/50 g), Apparent Density (g/cm$^3$)) and Green Properties (Ejection load and Strength) are reported. The mixture containing oleamide did not flow and this prevented the measurement of the Apparent Density and Flow Rate. Lubricant A was prepared by intimately mixing 60% by weight ethylenebisstearamide with 20% by weight of oleamide with 20% by weight of lithium stearate. Lubricant A was free-flowing and gave an ejection load which was much lower than that expected on the basis of the ejection loads for compositions comprising just the individual components. The synergistic effect of the lubricant composition for powder metallurgy comprising oleamide and at least one other powder metallurgy lubricant in admixture was unexpected.

TABLE II

| Lubricant | Powder Flow Rate, sec/50 g | Powder App. Dens., g/cm$^3$ |
|---|---|---|
| Ethylenebisstearamide | 31.4 | 3.06 |
| Lithium stearate | 35.8 | 3.32 |
| Oleamide | No Flow | No Flow |
| Lubricant A | 28.2 | 3.22 |
| | Green Ejection, | Green Strength, |

TABLE II-continued

| Lubricant | lbs.f | MPa |
|---|---|---|
| Ethylenebisstearamide | 5997 | 12.11 |
| Lithium stearate | 5963 | 8.82 |
| Oleamide | 5143 | 16.28 |
| Lubricant A | 5233 | 10.72 |

I claim:

1. A composition of matter for the manufacture of a sintered metal article comprising a sinterable mixture comprising a metal powder and a particulate lubricant, said lubricant being present in an amount of 0.1% to 5%, by weight, said lubricant comprising a mixture of discrete particles of a fatty monoamide and discrete particles of at least one other powder metallurgy lubricant comprising a metal stearate other than zinc stearate.

2. A composition according to claim 1 wherein said fatty monoamide is selected from the group consisting of caprylamide, pelargonamide, capramide, lauramide, myristamide, palmitamide, stearamide, arachidamide, behenamide, stearyl stearamide, palmitoleamide, oleamide, erucamide, linoleamide, linolenamide, oleyl palmitamide, stearyl erucamide, erucyl erucamide, oleyl oleamide, erucyl stearamide, and ricinoleamide.

3. A composition according to claim 1 wherein said fatty monoamide is oleamide.

4. A composition according to claim 1 wherein said metal stearate is selected from the group consisting of lithium stearate and lithium 12-hydroxystearate.

5. A composition according to claim 1 wherein said metal powder is an iron-based powder.

6. A composition according to claim 5, wherein said iron-based metal powder contains graphite as an additive.

7. A composition according to claim 5, wherein said iron-based metal powder contains copper as an additive.

8. A composition according to claim 3 wherein said particulate lubricant contains from 10 to 60%, by weight, of discrete particles of oleamide and from 90 to 40%, by weight, of discrete particles of said at least one other powder metallurgy lubricant.

9. A composition according to claim 8, wherein said at least one other lubricant comprises said metal stearate. said stearate being selected from the group consisting of lithium stearate and lithium 12-hydroxystearate; and a lubricant selected from the group consisting of fatty amides selected from the group consisting of caprylamide, pelargonamide, capramide, lauramide, myristamide, palmitamide, stearamide, arachidamide, behenamide, stearyl stearamide, palmitoleamide, oleamide, erucamide, linoleamide, linolenamide, oleyl palmitamide, stearyl erucamide, erucyl erucamide, oleyl oleamide, erucyl stearamide, and ricinoleamide; fatty bisamides selected from the group consisting of ethylenebisstearamide, ethylenebisoleamide and ethylenebis 12-hydroxystearamide; and fatty acids.

10. A synergistic free-flowing lubricant composition for powder metallurgy comprising discrete particles of a fatty monoamide, and discrete particles of at least one other powder metallurgy lubricant comprising a metal stearate other than zinc stearate in admixture.

11. A composition according to claim 10 wherein said fatty monoamide is selected from the group consisting of caprylamide, pelargonamide, capramide, lauramide, myristamide, palmitamide, stearamide, arachidamide, behenamide, stearyl stearamide, palmitoleamide, oleamide, erucamide, linoleamide, linolenamide, oleyl palmitamide, stearyl erucamide, erucyl erucamide, oleyl oleamide, erucyl stearamide, and ricinoleamide.

12. A composition according to claim 10 wherein said fatty monoamide in said admixture is oleamide.

13. A composition according to claim 10 wherein said metal stearate is selected from the group consisting of lithium stearate and lithium 12-hydroxystearate.

14. A composition according to claim 10, wherein said at least one other powder metallurgy lubricant comprises said metal stearate, said stearate being selected from the group consisting of lithium stearate and lithium 12-hydroxystearate; and a lubricant selected from the group consisting of fatty bisamides selected from the group consisting of ethylenebisstearamide and ethylenebisoleamide, ethylenebis 12-hydroxystearamide, and fatty acids.

15. A composition according to claim 10, wherein said fatty monoamide is oleamide, and said at least one other powder metallurgy lubricant comprises ethylenebisstearamide and lithium stearate.

16. A method of forming a sintered metal part comprising:

compacting a sinterable powdered metal in admixture with a particulate lubricant in a mold to form a compacted powdered metal part, removing the compacted part from the mold, heating the compacted part to decompose and remove the lubricant and sinter the particles of metal with formation of the sintered metal part, said lubricant comprising a mixture of discrete particles of a fatty monoamide and discrete particles of at least one other powder metallurgy lubricant comprising a metal stearate other than zinc stearate.

17. A method according to claim 16 wherein said fatty monoamide is selected from the group consisting of caprylamide, pelargonamide, capramide, lauramide, myristamide, palmitamide, stearamide, arachidamide, behenamide, stearyl stearamide, palmitoleamide, oleamide, erucamide, linoleamide, linolenamide, oleyl palmitamide, stearyl erucamide, erucyl erucamide, oleyl oleamide, erucyl stearamide, and ricinoleamide.

18. A method according to claim 16 wherein said at least one other powder metallurgy lubricant comprises said metal stearate, said metal stearate being selected from the group consisting of lithium stearate and lithium 12-hydroxystearate; and a lubricant selected from the group of fatty bisamides consisting of ethylenebisstearamide, ethylenebisoleamide, ethylenebis 12-hydroxystearamide, or fatty acids.

19. A method according to claim 16 wherein said fatty monoamide in said mixture is oleamide.

20. A method according to claim 19 wherein said at least one other powder metallurgy lubricant comprises said metal stearate, said metal stearate being selected from the group consisting of lithium stearate and lithium 12-hydroxystearate; and a lubricant selected from the group consisting of ethylenebisstearamide and stearic acid.

21. A method according to claim 16 wherein the fatty monoamide is oleamide, and said at least one other powder metallurgy lubricant comprises ethylenebisstearamide and lithium stearate.

22. A method according to claim 16 wherein said lubricant mixture contains from 10 to 60%, by weight, of said fatty monoamide and from 90 to 40%, by weight, of said at least one other metallurgy lubricant and said mixture comprises 0.1% to 5%, by weight, of said compacted powdered metal part.

23. A method according to claim 22 wherein said at least one other powder metallurgy lubricant comprises said metal stearate, said metal stearate being selected from the group consisting of metal stearates selected from the group consisting of lithium stearate and lithium 12-hydroxystearate; and a lubricant selected from the group consisting of fatty bisamides selected from the group consisting of ethylenebisstearamide, ethylenebisoleamide and ethylenebis 12-hydroxystearamide, and fatty acids.

24. A method according to claim 22 wherein said fatty monoamide is oleamide, and said at least one other powder metallurgy lubricant comprises ethylenebisstearamide and lithium stearate.

* * * * *